United States Patent [19]

Takahashi

[11] Patent Number: 4,541,711

[45] Date of Patent: Sep. 17, 1985

[54] RECORDING APPARATUS

[75] Inventor: Yuji Takahashi, Tokyo, Japan

[73] Assignee: Canon Kabushiki Kaisha, Tokyo, Japan

[21] Appl. No.: 547,037

[22] Filed: Oct. 31, 1983

[30] Foreign Application Priority Data

Nov. 9, 1982 [JP] Japan ..... 57-195328

[51] Int. Cl.[4] ..... G03G 15/00

[52] U.S. Cl. ..... 355/14 R; 355/14 SH; 346/153.1; 346/160

[58] Field of Search ..... 355/14 SH, 14 R, 3 R, 355/3 SH; 346/108, 153.1, 160; 358/300

[56] References Cited

U.S. PATENT DOCUMENTS

| | | | |
|---|---|---|---|
| 4,332,463 | 6/1982 | Firth et al. | 355/14 R |
| 4,395,111 | 7/1983 | Takahashi et al. | 355/3 SH X |
| 4,416,534 | 11/1983 | Kluger | 355/14 SH |
| 4,445,128 | 4/1984 | Dolan et al. | 346/160 |

*Primary Examiner*—A. T. Grimley
*Assistant Examiner*—J. Pendegrass
*Attorney, Agent, or Firm*—Fitzpatrick, Cella, Harper & Scinto

[57] ABSTRACT

A recording apparatus in which the sheet transporting speed is detected and is corrected according to the result of detection, in order to compensate dimensional fluctuations in the sheet transporting members.

6 Claims, 11 Drawing Figures

FIG. 5(A) PRINT COMMAND
FIG. 5(B) IMAGE OUTPUT
FIG. 5(C) FEED CLUTCH
FIG. 5(D) REGIST CLUTCH
FIG. 5(E) SENSOR S1
FIG. 5(F) SENSOR S2
T0
τp
Δt
T2
T2'
τ2
T1
τ1
T3
τ3
T4
T4'
τs'
T5
T5'
τs

RECORDING APPARATUS

BACKGROUND OF THE INVENTION

1. Field of the Invention

The present invention relates to a recording apparatus for image recording on a transported recording medium.

2. Description of the Prior Art

In conventional recording apparatus such as copiers or laser beam printers, there are usually employed paired rubber or metal rollers for transporting a recording medium to the recording station, and the dimensional tolerance of such rollers has to be precisely controlled since the diameter of said rollers directly determines the sheet transporting speed. In addition linearity, surface coarseness, handling etc. of said rollers have to be controlled, and such factors have led to an increased manufacturing cost. Also during the use in the recording apparatus, the roller diameter decreases gradually due to abrasion by the passing recording medium thus reducing the transporting speed and giving rise to aberration of the image position on the recording medium.

SUMMARY OF THE INVENTION

An object of the present invention, achieved in consideration of the foregoing, is to provide a recording apparatus capable of preventing aberration in the image position on the recording medium.

Another object of the present invention is to provide a recording apparatus allowing crude control on the precision of the transporting members and capable of preventing aberration in the image position resulting from a time-dependent change of the transporting member.

Still another object of the present invention is to provide a recording apparatus capable of detecting the transporting speed of the recording medium and regulating the image position according to the result of said detection.

The foregoing and still other objects of the present invention will become fully apparent from the following description.

DETAILED DESCRIPTION OF THE PREFERRED EMBODIMENTS

Now the present invention will be clarified in detail by the following description to be taken in conjunction with the attached drawings.

Figure 1:
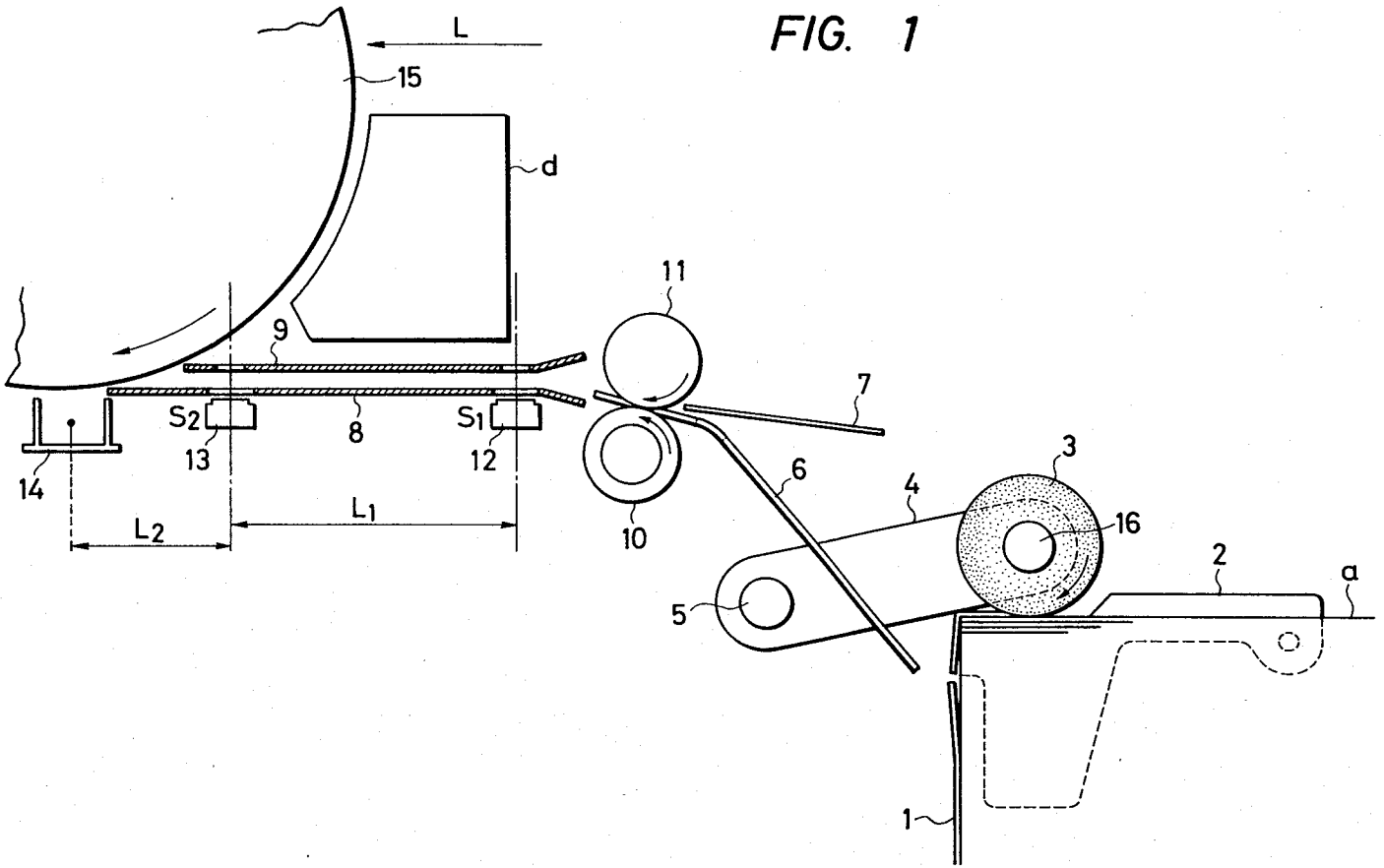
FIG. 1 is a schematic cross-sectional view of a sheet feeding unit.

FIG. 1 shows a principal part of a recording apparatus such as a laser beam printer, wherein cut sheets a constituting recording medium are stacked on a sheet feeding deck 1, and an uppermost sheet is pressed downwards at the front end portion thereof by a separating finger 2. On said cut sheets a feeding roller 3 is supported by a shaft 16 which is rotatable about a pin 5 by means of a feeding arm 4, and is maintained in contact with said cut sheets a. Rotation of the feeding roller 3 in a direction indicated by an arrow separates the uppermost sheet and advances said sheet between sheet guides 6, 7 toward a registration roller 10 and a pressure roller 11. After the front end of the sheet reaches the rollers 10, 11, the registration roller 10 is activated at a determined timing whereby the sheet of which the front end position is defined by the registration roller 10, is transported between the guides 8, 9. Reflection sensors 12, 13 provided in said guide member 8 detect the front end of the sheet, thus identifying whether the sheet is in determined positions at determined timings and detecting any eventual delay in the transportation. An electrostatic latent image formed on a photosensitive drum 15 in response to light irradiation L is developed by a developing unit d into a toner image, which is transferred, by means of a transfer charger 14, onto the sheet after the above-mentioned identification, during transportation thereof.

Figure 2:
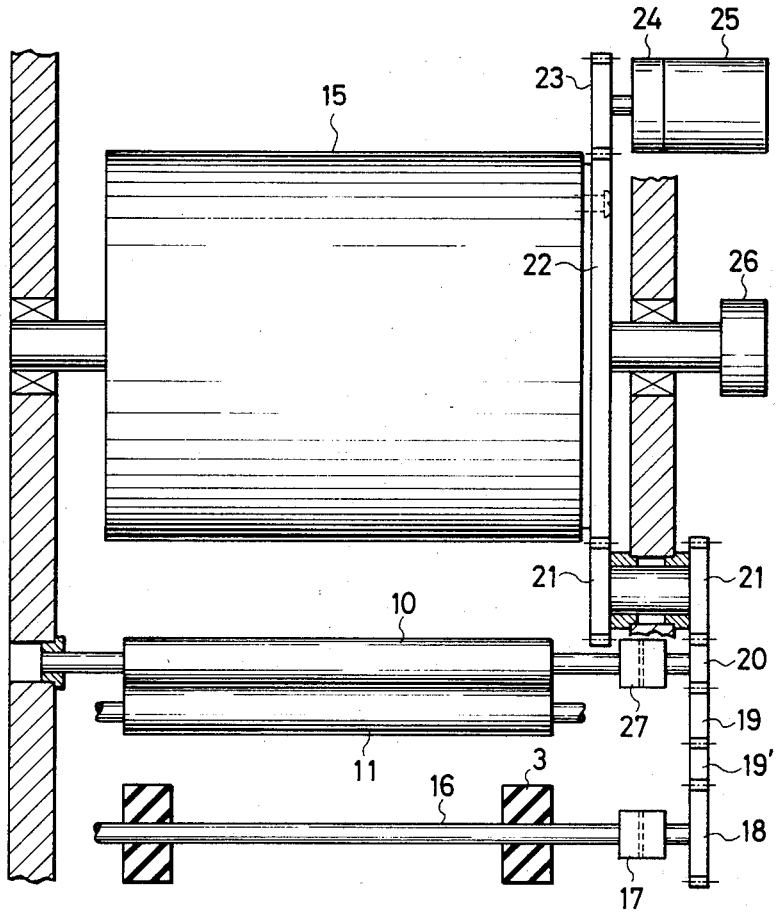
FIG. 2 is a plan view of a drive mechanism for sheet transportation.

FIG. 2 shows the outline of the transporting system, in which the rotation of a motor 25 is transmitted, through a reducer 24 and a driving gear 23 mounted on the output shaft thereof, to a drum gear 22. The photosensitive drum 15 is equipped with a photoencoder 26 integrally rotating therewith, and the image forming cycle is controlled by clock pulses released from said photoencoder. The drum gear 22 also rotates a registration gear 20 through an intermediate gear 21. Between said registration gear 20 and the registration roller 10 there is provided a clutch 27 for controlling the rotation of the registration roller 10, thus achieving sheet registration. Rotation is further transmitted from said registration gear 20 to a sheet feeding gear 18 through idler gears 19, 19'. Between said feeding gear 18 and the feeding shaft 16 there is provided a roller clutch 17 for achieving intermittent sheet feeding.

Figure 3:
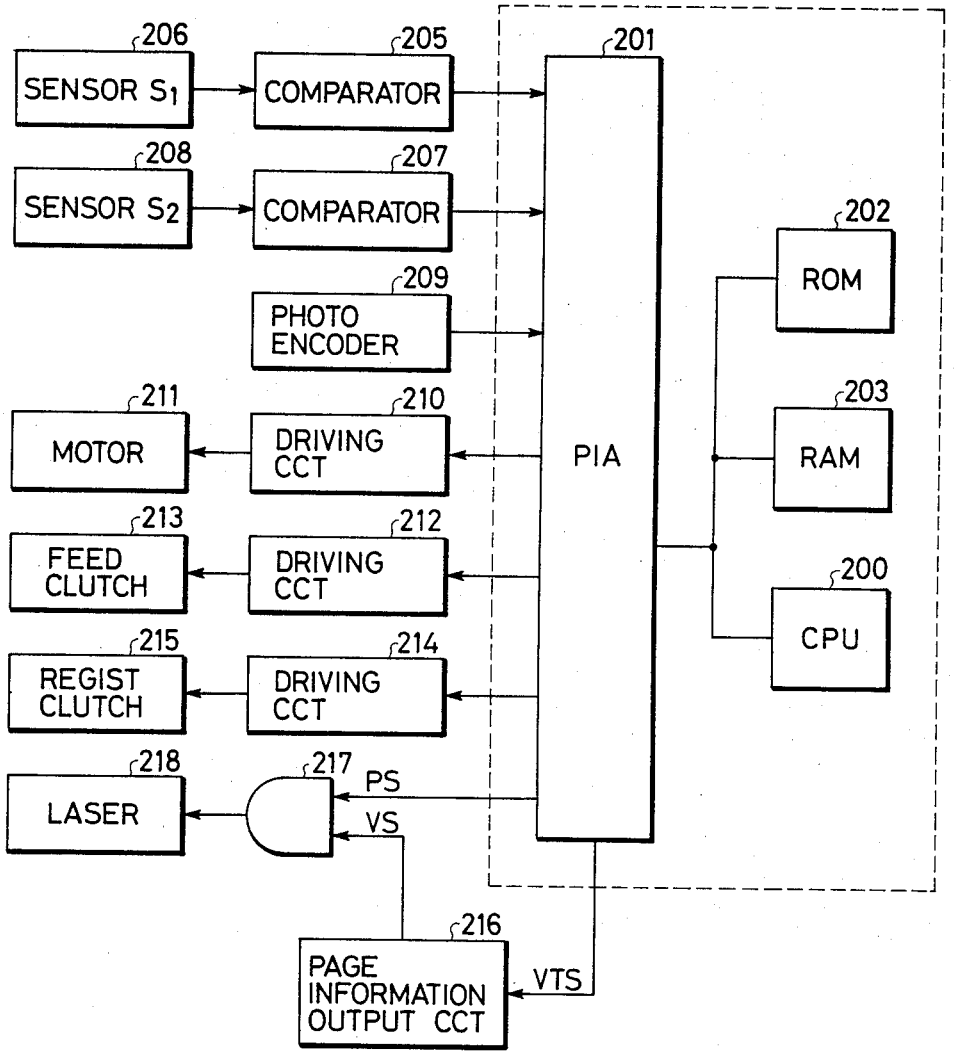
FIG. 3 is a block diagram of a control unit.

FIG. 3 is a block diagram of a control unit for the recording apparatus as shown in FIGS. 1 and 2, wherein an image is recorded on a photosensitive member by means of a semiconductor laser. A central processing unit (CPU) 200 governing the entire control is connected to a peripheral interface adapter (PIA) 201 for controlling input/output signals, a read-only memory (ROM) 202 for storing a program, and a random access memory 203 for storing data for executing the program. As an example the CPU 200 is composed of a known device M6800 manufactured by Motorola, and the PIA 201 is composed of a known device M6820 manufactured by Motorola.

The PIA 201 receives, through comparators 205, 207, a position signal from a photoencoder 209 corresponding to the photoencoder 26 in FIG. 2, and detection signals from sensors S1, S2 respectively corresponding to the sensors 12, 13 in FIG. 1, and supplies control signals to a motor 211 corresponding to the motor 25 in FIG. 2, a feeding clutch 213 corresponding to the clutch 17 in FIG. 2 and registration clutch 215 corresponding to the clutch 27 in FIG. 2, respectively through driving circuits 210, 212, 214. In response to a video timing signal VTS from the PIA 201, a page information output circuit 216 supplies a video signal VS to an AND gate 217 which also receives a permission signal PS from the PIA 201, whereby a semiconductor laser 218 is activated according to the output signal from the AND gate 217 to record an image on the photosensitive drum.

Figure 4:
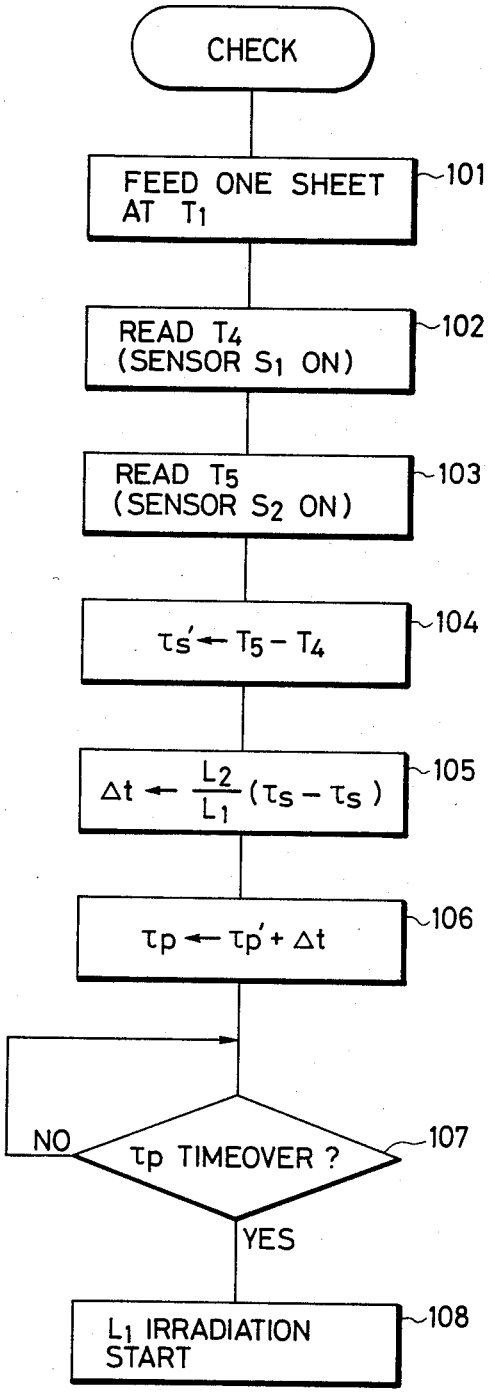
FIG. 4 is a flow chart showing the procedure of feed control according to the present invention.
Figure 5:
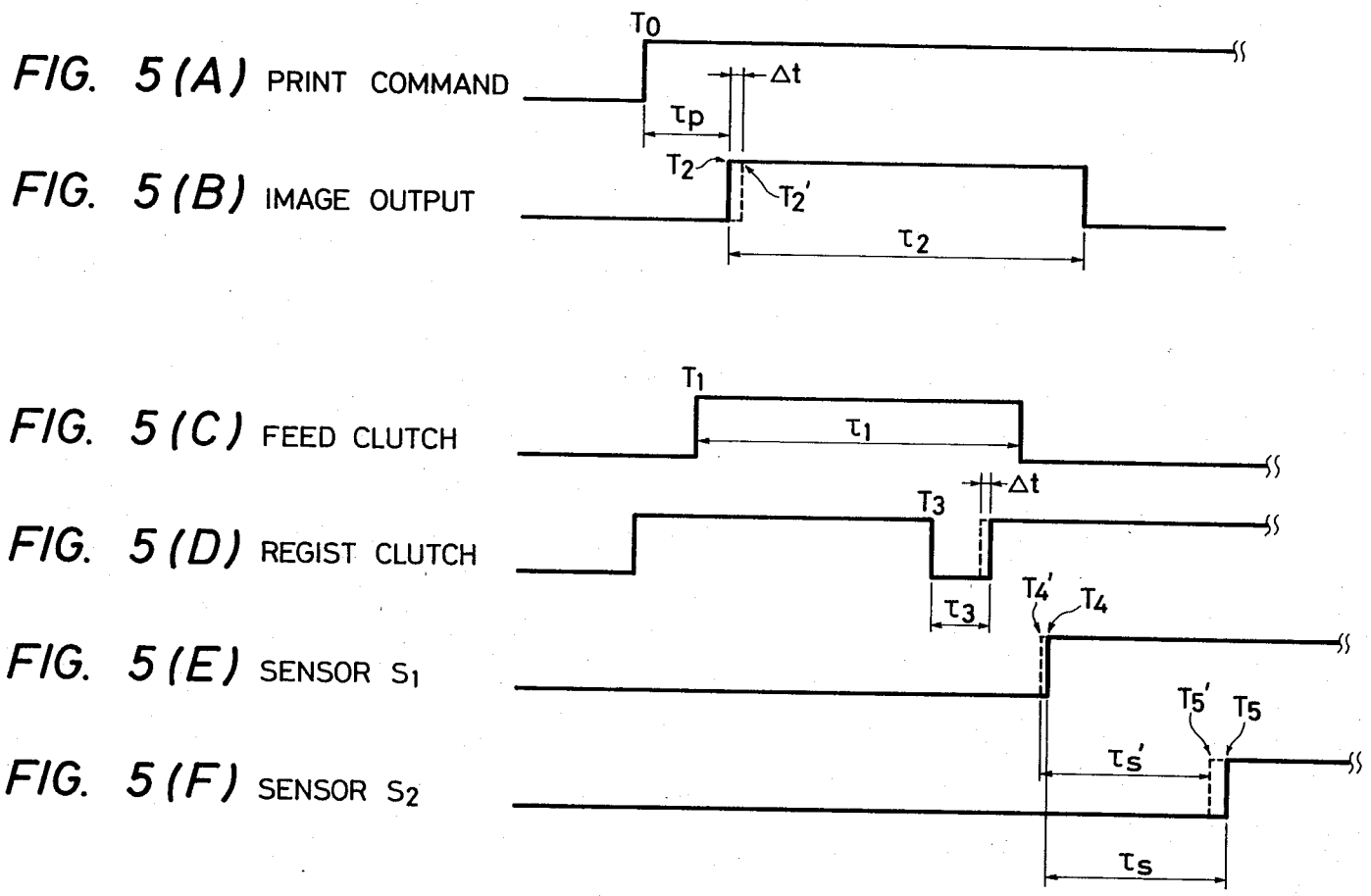
FIGS. 5A–5F are timing charts showing the functions of various parts under the control according to the flow chart shown in FIG. 4.

FIG. 4 shows a flow chart for correcting the positional aberration of the image according to the present invention, and FIG. 5 is a timing chart showing the functions of various units under the control according to the flow chart shown in FIG. 4.

Now reference is made to FIG. 5 for further clarifying the function of the present invention. A print instruction is entered at a time T0 as shown by a curve (A), and the feeding clutch 213 is energized for a period $\tau 1$ from a time T1 as shown by a curve (C). Then the registration clutch 215 is deactivated for a period $\tau 3$ from a time T3 as shown by a curve (D). On the other hand the video output instruction signal is activated, as shown by a curve (B), for a period $\tau 2$ from a time T2 delayed by a period $\tau_p$ from the print instruction at T0, thereby recording the image on the photosensitive drum 15. The sheet fed at the time T1 reaches the stopped registration roller during the period $\tau 3$, and is transported again after the expiration of said period $\tau 3$, actuating the sensors S1, S2 provided on the guide member respectively at times T4, T5. The transport speed of the sheet can be known by measuring the period $\tau_s$ between said times T4 and T5. Said transport speed v is given by $v=L1/\tau_s$ wherein the distance L1 stands for the distance between the sensors in FIG. 1, and the time required for traveling a distance L2 from the sensor S2 to the center of the transfer charger 14, with said speed v is given by $t=L2/v$.

In case the registration roller becomes thinner, the speed v changes to $v'=L1/\tau_s'$ and the time t changes to $t'=L2/v'$, so that the difference $\Delta t$ in time is represented by:

$$\Delta t=t-t'=L2/v-L2/v'=L2/L1\times(\tau_s-\tau_s').$$

It is therefore rendered possible to compensate the delay in the sheet transportation and to transfer the image onto a determined position on the sheet by adding the time $\Delta t$ determined above to the waiting time $\tau_p$ from the print instruction to the output of the image signal. On the other hand, the difference $\Delta t$ becomes negative if the registration roller is thicker than the determined value. In such case the waiting time is reduced by adding $\Delta t$, including the sign thereof, to said waiting time $\tau_p$.

In the foregoing embodiment the image position at the image transfer is regulated by changing the starting time of image recording, but the image position can also be regulated by changing the turned-off period $\tau 3$ of the registration roller. More specifically the timing of image transfer can be controlled by subtracting the difference $\Delta t$ from the turned-off period $\tau 3$ of the registration roller. The difference $\Delta t$ may become negative if the registration roller is thicker than the determined value, so that the waiting time $\tau 3-\Delta t$ increases in such case. In this manner the start timing of the image recording or the turned-off time of the registration roller is controlled according to the sheet transporting speed and to the sheet position.

Now reference is made to FIG. 4 showing the control procedure according to the present invention. In this embodiment the transport speed of the sheet to the recording unit is detected and compared with a predetermined reference speed, and the start of recording at said recording unit is controlled according to the result of said comparison.

The checking procedure explained in the following may be conducted during the normal printing operation, or conducted as a part of self-check in the inspection of the apparatus. At first a step 101 energizes the feeding clutch 213, thus feeding a sheet at a determined timing by means of the feeding roller 3. The sheet A supplied between the guides 6, 7 collides with the stopped registration rollers 10, 11, and, upon energization of the clutch 215, is advanced between the guides 8, 9 by means of said rollers 10, 11. Steps 102, 103 read the signals from the sensors S1, S2 to calculate the time difference $\tau_s'$ required by the sheet to move between the sensors. A step 105 calculates the correction constant $\Delta t$ from the constants $\tau_s$, L2 and L1 determined in advance. A step 106 calculates the time $\tau_p$ anew by adding the correction constant $\Delta t$ to the start timing $\tau_p'$. A step 107 identifies the expiration of the renewed period $\tau_p$, and, after said expiration, the semiconductor laser 218 is activated to start the emission of the light beam L1. In said step 106, instead of regulating the waiting time $\tau_p$, a new waiting time $\tau 3$ may be calculated by subtracting $\Delta t$ from $\tau 3$. In such case the step 107 identifies the expiration of the period $\tau 3$, and the step 108 activates the registration clutch 215 upon said expiration.

In the foregoing explanation the timing control is achieved by time measurement, but it will be evident that a similar control is possible by counting the number of pulses released from an encoder as shown in FIG. 2.

Figure 6:
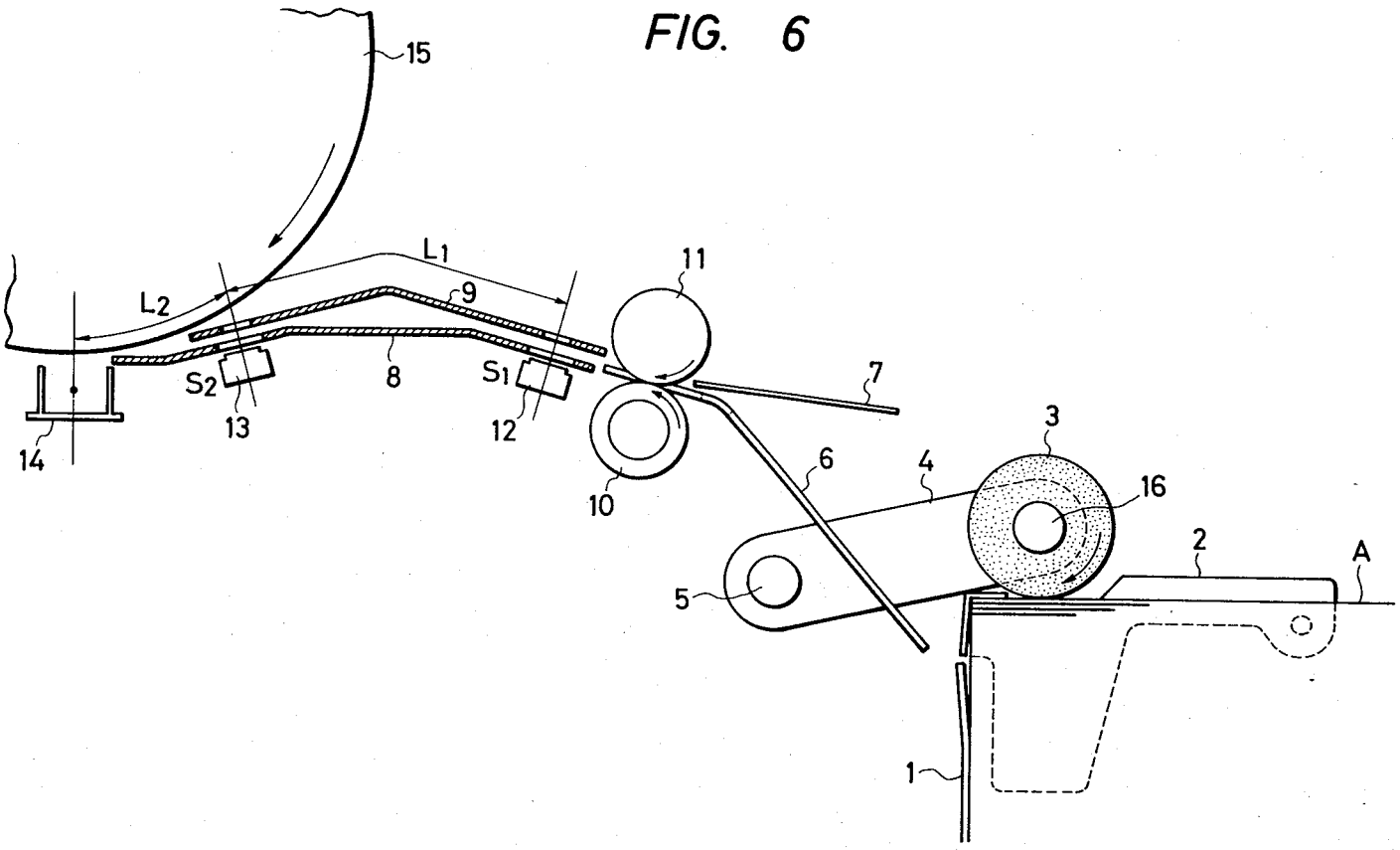
FIG. 6 is a cross-sectional view of an apparatus showing another embodiment of the present invention.

FIG. 6 shows a modification of the embodiment shown in FIG. 1, wherein the guide member 9 is modified in shape in such a manner that the sheet can proceed along the inner face of the guide 9. Image blur does not occur if the sheet transport speed v is equal to the peripheral speed V of the photosensitive drum. However, if said speeds are mutually different, image blur occurs because of the difference in speeds. In order to prevent such situation, the guide member is preferably provided with a buffer function, in order to absorb the difference through a change in the running path of the sheet in said guide member. In case of $v<V$, the front end of the sheet adheres to the drum by the electrostatic force of the transfer charger and absorbs the change in the speed by changing the running direction toward the guide member 8. On the other hand, if $v>V$, the sheet is bent in a space between the guide members 8 and 9, thus absorbing the deviation in the speed. In FIG. 6, same components as those in FIG. 1 are represented by same numbers.

In the foregoing embodiment the transport speed is detected by two sensors, but it is also possible to determine the transport speed by detecting the passing time of a sheet with a single sensor.

In the foregoing embodiments the electrophotographic process is employed in the recording apparatus, but the present invention is not limited to such embodiment and is applicable also to other apparatus in which the image is directly recorded on a sheet for example by an ink jet serial printer or a thermal printer.

As explained in the foregoing, optimum image registration is rendered possible by detecting the transport speed of the recording medium. It is therefore rendered possible to apply cruder control on the precision of the transporting members, and to prevent aberration in the image position resulting from time-dependent changes of the transporting members.

What I claim is:

1. A recording apparatus comprising:

recording means for image recording on a recording medium;

transport means for transporting the recording medium to said recording means;

detecting means for detecting the recording medium by monitoring a transporting condition of the recording medium transported by said transport means; and control means for obtaining a transport speed of the recording medium according to an output of said detecting means and regulating the image position on said recording medium in accordance with said transport speed.

2. A recording apparatus according to claim 1, wherein said control means is adapted to control the start timing of image recording by said recording means.

3. A recording apparatus according to claim 2, wherein said recording means is adapted to form an electrostatic latent image on a photosensitive member in response to image information and, image development, to transfer thus developed image onto said recording medium, and said control means is adapted to control the start timing of image recording on said photosensitive member.

4. A recording apparatus according to claim 3, wherein said recording means is adapted to record image information by means of a laser beam on said photosensitive member, and said start timing of image recording is a timing for starting the activation of said laser beam.

5. A recording apparatus according to claim 1, wherein said control means is adapted to control the feed timing of the transport of the recording medium by said transport means to a recording position.

6. A recording apparatus according to claim 5, wherein said recording means comprises process means for forming an electrostatic latent image on a photosensitive member in accordance with image information and, after image development, transferring the thus developed image onto a recording medium, said transport means comprising registration means for controlling the feed timing of the recording medium to a transfer position, wherein said control means is adapted to control the timing for driving said registration means.

* * * * *